US006103673A

United States Patent [19]

Sumiejski et al.

[11] Patent Number: 6,103,673

[45] Date of Patent: Aug. 15, 2000

[54] COMPOSITIONS CONTAINING FRICTION MODIFIERS FOR CONTINUOUSLY VARIABLE TRANSMISSIONS

[75] Inventors: James L. Sumiejski, Mentor; William C. Ward, Jr., Perry, both of Ohio

[73] Assignee: The Lubrizol Corporation, Wickliffe, Ohio

[21] Appl. No.: 09/152,878

[22] Filed: Sep. 14, 1998

[51] Int. Cl.[7] ..... C10M 141/12; C10M 141/10

[52] U.S. Cl. ..... 508/186; 508/195; 508/199; 508/433; 508/444; 252/78.1

[58] Field of Search ..... 508/186

[56] References Cited

U.S. PATENT DOCUMENTS

| | | | |
|---|---|---|---|
| 3,652,410 | 3/1972 | Hollinghurst et al. | 252/32.7 |
| 3,829,381 | 8/1974 | LeSuer | 508/186 |
| 4,031,020 | 6/1977 | Sigiura et al. | 252/56 |
| 4,299,714 | 11/1981 | Sigiura et al. | 252/73 |
| 4,792,410 | 12/1988 | Schwind et al. | 252/38 |
| 5,064,546 | 11/1991 | Dasai | 252/32.5 |
| 5,284,591 | 2/1994 | Bayles et al. | 252/33 |
| 5,364,994 | 11/1994 | Scharf | 585/3 |
| 5,387,346 | 2/1995 | Hartley et al. | 252/49.9 |
| 5,449,470 | 9/1995 | Cahoon et al. | 252/18 |
| 5,516,440 | 5/1996 | Dasai et al. | 252/32 |
| 5,635,459 | 6/1997 | Stoffa et al. | 508/186 |
| 5,759,965 | 6/1998 | Sumiejski | 508/186 |
| 5,792,731 | 8/1998 | Ichihashi et al. | 508/322 |

FOREIGN PATENT DOCUMENTS

| | | |
|---|---|---|
| 0 753 564 | 1/1997 | European Pat. Off. . |
| 0 761 805 | 3/1997 | European Pat. Off. . |

OTHER PUBLICATIONS

Japanese Patent Application 2–175794, Jul. 9, 1990, as Derwent Abstract C90–108912.
PCT Application WO 97/14770, Apr. 24, 1997.
PCT Publication WO 97/04049, Feb. 6, 1997.

*Primary Examiner*—Ellen M. McAvoy
*Attorney, Agent, or Firm*—David M. Shold

[57] ABSTRACT

A composition comprising of an oil of lubricating viscosity; a shear stable viscosity modifier; at least 0.1 percent by weight of an overbased metal salt; at least 0.1 percent by weight of at least one phosphorus compound; and 0.1 to 0.25 percent by weight of a combination of at least two friction modifiers provides an improved fluid for continuously variable transmissions. At least one of the friction modifiers is selected from the group consisting of zinc salts of fatty acids having at least 10 carbon atoms, hydrocarbyl imidazolines containing at least 12 carbon atoms in the hydrocarbyl group, and borated epoxides. The total amount of the friction modifiers is limited to those amounts which provide a metal-to-metal coefficient of friction of at least about 0.120 as measured at 110° C. by ASTM-G-77.

33 Claims, No Drawings

COMPOSITIONS CONTAINING FRICTION MODIFIERS FOR CONTINUOUSLY VARIABLE TRANSMISSIONS

BACKGROUND OF THE INVENTION

The present invention relates to compositions useful as transmission fluids, and particularly as fluids for continuously variable transmissions.

Continuously variable transmissions (CVT) represent a radical departure from conventional automatic transmission. The bush belt version of the CVT was invented by Dr. Hub Van Doorne, and since its introduction, many cars have been equipped with the push belt CVT system. CVTs are manufactured by Van Doorne's Transmissie VB of Tilburg, the Netherlands. A more detailed description of such transmissions and belts and lubricants employed therein is found in European Patent Application 753 564, published Jan. 15, 1997, as well as references cited therein. In brief, a belt and pulley system is central to the operation of this type of transmission. The pulley system comprises a pair of pulleys with a V-shaped cross-section, each consisting of a moveable sheave, a fixed sheave, and a hydraulic cylinder. Between the pulleys runs a belt, which consists of a set of metal elements held together by metal bands. In operation, the driving pulley pushes the belt to the driven pulley, thereby transferring power from the input to the output. The transmission drive ratio is controlled by opening or closing the moveable sheaves so that the belt rides lower or higher on the pulley faces. This manner of operation permits continuous adjustment of gear ratio between the input and output shafts.

It has become clear from commercial use of the CVT that the fluids used in the CVT are just as important as the mechanical design for satisfactory operation. The lubricant must fulfill several functions: to lubricate the metal belt in its contacts with the pulley assembly, the planetary and other gears, the wet-plate clutches, and the bearings; to cool the transmission; and to carry hydraulic signals and power. The hydraulic pressure controls the belt traction, transmission ratio, and clutch engagement. The lubricant must provide the appropriate degree of friction between the belt and pulley assembly, to avoid the problem of slippage on one hand, and binding on the other, all the while providing protection to the metal surfaces from pitting, scuffing, scratching, flaking, polishing, and other forms of wear. Accordingly, the fluid should maintain a relatively high coefficient of friction for metal/metal contact, as well as exhibiting a suitable degree of shear stability.

Copending U.S. patent application Ser. No. 08/500,810, Sumiejski et al., filed Jul. 10, 1995, which is equivalent to EP 0 753 564 referred to above, published Jan. 15, 1997, discloses a shear stable lubricating/functional fluid composition, comprising an oil of lubricating viscosity, 1–15% by weight of the metal salt of an organic acid, and 1–25% viscosity modifier, wherein the composition has certain defined viscosity. Other components in the additive package include a metal dialkyl dithiophosphate, sulfur containing friction modifiers, dialkyl phosphites, and fatty amides.

European Application 761 805, Mar. 12, 1997, discloses a lubricating/functional fluid which comprises an oil of lubricating viscosity, 2,5dimercapto-1,3,4-thiadiazole or a derivative thereof and an antifoam agent. The composition may include phosphoric acid. Friction modifiers are included in the compositions in the amounts of 0.1–10 weight percent and may be a single friction modifier or mixtures of two or more. Friction modifiers also include metal salts of fatty acids. Preferred cations are zinc, magnesium, calcium, and sodium and any other alkali, or alkaline earth metals may be used. The salts may be overbased by including an excess of cations per equivalent of amine [sic; acid?]. Zinc salts are added in amounts of 0.1–5 weight percent to provide antiwear protection. The zinc salts are normally added as zinc salts of phosphorodithioic acids.

U.S. Pat. No. 4,792,410, Dec. 20, 1988, Schwind et al., discloses a lubricant mixture suitable for a manual transmission fluid, comprising a boronated overbased alkali metal or alkaline earth metal salt, a friction modifier or mixture of friction modifiers, and an oil of lubricating viscosity.

SUMMARY OF THE INVENTION

The present invention provides a composition comprising:

(a) a major amount of an oil of lubricating viscosity;

(b) a viscosity modifying amount of a shear stable viscosity modifier;

(c) at least 0.1 percent by weight of an overbased metal salt, wherein said overbased salt contributes 0.5 to 10 Total Base Number to the composition;

(d) at least 0.1 percent by weight of a phosphorus compound; and (e) 0.1 to 0.25 percent by weight of a combination of at least two friction modifiers, at least one of said friction modifiers being selected from the group consisting of zinc salts of fatty acids having at least 10 carbon atoms, hydrocarbyl imidazolines containing at least 12 carbon atoms in the hydrocarbyl group, and borated epoxides; the amount of the friction modifier from said group being at least 0.03 percent by weight of the composition;

provided that the total amount of the friction modifiers is limited to those amounts which provide a metal-to-metal coefficient of friction of at least 0.120 as measured at 110° C. by ASTM-G-77, using the composition as a lubricant.

In another embodiment, the invention provides a composition comprising:

(a) an oil of lubricating viscosity;

(b) 2 to 20 parts by weight of a shear stable viscosity modifier;

(c) 0.2 to 1.5 parts by weight of an overbased metal salt;

(d) 0.14 to 0.25 parts by weight of at least one phosphorus compound; and (e) 0.15 to 0.3 parts by weight of a combination of at least two friction modifiers, at least one of said friction modifiers being selected from the group consisting of zinc salts of fatty acids having at least 10 carbon atoms, hydrocarbyl imidazolines containing at least 12 carbon atoms in the hydrocarbyl group, and borated epoxides; the amount of the friction modifier from said group being at least 0.03 parts by weight.

The invention also provides a method for lubricating a transmission, including continuously variable transmissions of various types, comprising adding thereto the foregoing composition.

DETAILED DESCRIPTION OF THE INVENTION

Various preferred features and embodiments will be described below by way of non-limiting illustration.

The first component of the present invention is an oil of lubricating viscosity which is generally present in a major amount (i.e. an amount greater than 50% by weight). Generally, the oil of lubricating viscosity is present in an amount of greater than 80% by weight of the composition, typically at least 85%, preferably 90 to 95%. Such oil can be derived from a variety of sources, and includes natural and synthetic lubricating oils and mixtures thereof.

The natural oils useful in making the inventive lubricants and functional fluids include animal oils and vegetable oils (e.g., lard oil, castor oil) as well as mineral lubricating oils such as liquid petroleum oils and solvent treated or acid-treated mineral lubricating oils of the paraffinic, naphthenic or mixed paraffinic/naphthenic types which may be further refined by hydrocracking and hydrofinishing processes and are dewaxed. Oils of lubricating viscosity derived from coal or shale are also useful. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); poly(1-hexenes), poly-(1-octenes), poly(1-decenes), etc. and mixtures thereof; alkyl-benzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_{3-8}$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl)silicate, hexyl-(4-methyl-2pentoxy) disiloxane, poly(methyl)siloxanes, poly(methylphenyl) siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Another class of oils is known as traction oils, which are typically synthetic fluids containing a large fraction of highly branched or cycloaliphatic structures, i.e., cyclohexyl rings.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, hydroprocessing, hydrocracking, and hydrotreating. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

In one embodiment, the oil of lubricating viscosity is a poly-alpha-olefin (PAO). Typically, the poly-alpha-olefins are derived from monomers having from 4 to 30, or from 4 to 20, or from 6 to 16 carbon atoms. Examples of useful PAOs include those derived from 1-decene. These PAOs may have a viscosity from 2 to 150.

Preferred base oils include poly-(α-olefins such as oligomers of 1-decene. These synthetic base oils are hydrogenated resulting in an oil of stability against oxidation. The synthetic oils may encompass a single viscosity range or a mixture of high viscosity and low viscosity range oils so long as the mixture results in a viscosity which is consistent with the requirements set forth below. Also included as preferred base oils are highly hydrocracked and dewaxed oils. These petroleum oils are generally refined to give enhanced low temperature viscosity and antioxidation performance. Mixtures of synthetic oils with refined mineral oils may also be employed.

It is important, for optimum utility in a CVT application, that the composition exhibit well-defined and shear-stable viscosity parameters. In particular, the composition should have a Brookfield viscosity at −40° C. of less than 20,000 cP as determined by ASTM-D-2983, preferably less than 15,000 cP, and more preferably less than 10,000 cP. The low temperature viscosity is largely a function of the nature of the oil of lubricating viscosity, along with proper choice of viscosity modifier, and proper selection of low viscosity oils can aid in meeting this parameter.

The compositions of the present invention should likewise have a defined and stable high temperature viscosity, preferably, an initial kinematic viscosity of 7 to 8 cSt when measured at 100° C. This viscosity is obtained by selection of an appropriate viscosity modifier, as described below. Moreover, the viscosity modifier should be a shear stable viscosity modifier, such that the kinematic viscosity of the composition is not less than 6.5 cSt, preferably 6.7 cSt, more preferably 7 cSt at 100° C. when measured after a 20 hour Tapered Bearing Shear Test, DIN 51 350, part 6.

The second component of the present invention is a shear stable viscosity modifier ("VM," also referred to as a viscosity index improver). Viscosity modifiers are extremely well known in the art and most are commercially available. Hydrocarbon VMs include polybutenes, poly(ethylene/propylene) copolymers, and polymers of styrene with butadiene or isoprene. Ester VMs include esters of styrene/maleic anhydride polymers, esters of styrene/maleic anhydride/acrylate terpolymers, and polymethacrylates. The acrylates are available from RohMax and from The Lubrizol Corporation; polybutenes from Ethyl Corporation and Lubrizol; ethylene/propylene copolymers from Exxon and Texaco; polystyrene/isoprene polymers from Shell; styrene/maleic esters from Lubrizol, and styrene/butadiene polymers from BASF.

In the present invention the preferred VM is an acrylate- or methacrylate-containing copolymer or a copolymer of styrene and an ester of an unsaturated carboxylic acid such as styrene/maleic ester (typically prepared by esterification of a styrene/maleic anhydride copolymer). Preferably the viscosity modifier is a polymethacrylate viscosity modifier. Polymethacrylate viscosity modifiers are prepared from mixtures of methacrylate monomers having different alkyl groups. The alkyl groups may be either straight chain or branched chain groups containing from 1 to 18 carbon atoms. When a small amount of a nitrogen-containing monomer is copolymerized with alkyl methacrylates, dispersancy properties are also incorporated into the product. Thus, such a product has the multiple function of viscosity modification, pour point depressancy and dispersancy. Such products have been referred to in the art as dispersant-type viscosity modifiers or simply dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers. It is preferred that the viscosity modifier of the present invention is a dispersant viscosity modifier.

Some of the nitrogen-containing dispersant viscosity modifiers of the present invention can be prepared by a process comprising reacting, in the presence of a free radical initiator, (A) 55% to 99.9% by weight, preferably 75 to 99.5% by weight, more preferably 90 to 99%, often 80 to 99% by weight of one or more alkyl acrylate ester monomers containing from 1 to 24 carbon atoms in the ester alkyl group, wherein at least 50 mole % of the esters contain at least 6 carbon atoms, preferably at least 8 carbon atoms, in the ester alkyl group, and (B) 0.1% to 45% by weight, preferably 0.5 to 25% by weight, often 0.5 to 20% or 0.5 to 10%, often 1% to 20%, more preferably 1 to 10%, and in one embodiment 1.5 to 8% by weight of at least one nitrogen-containing monomer selected from the group consisting of vinyl substituted nitrogen heterocyclic monomers, dialkylaminoalkyl acrylate monomers, dialkylaminoalkyl acrylamide monomers, N-tertiary alkyl acrylamides, and vinyl substituted amines, provided that the total of the percentages of (A) and (B) equals 100%. The reaction is optionally conducted also in the presence of a chain transfer agent.

In a preferred process, monomer (A), the free radical initiator, and the chain transfer agent, if any, are first combined to form a mixture, whereupon 10% to 80% of said mixture is mixed with monomer (B), heating 20% to 100%, often 20% to 80%, more often 30% to 60%, and in one preferred embodiment 100%, of the resulting mixture until an exotherm is noted, then, while maintaining reaction temperature, first adding the balance, if any, of the mixture of monomers (A) and (B) over 0.25 hour to 5 hours followed by addition over 0.25 to 5 hours of the remaining mixture of monomer (A) and initiator, and then optionally adding additional initiator as may be required, whereupon the reaction is continued to completion.

Any combination of the foregoing ratios of reactants is useful provided the total percentages equals 100%.

(A) The Alkyl Acrylate Ester Monomer

As stated hereinabove, the nitrogen-containing copolymer comprises units derived from (A) alkyl acrylate ester monomers containing from 1 to 24 carbon atoms in the ester alkyl group. At least 50 mole % of such monomers contain at least 6, preferably at least 8, carbon atoms in the ester alkyl group. Often (A) comprises a mixture of ester monomers, having (a) 5% to 75% by weight, preferably 30% to 60% by weight of alkyl acrylate ester monomers containing from 1 to 11 carbon atoms in the ester alkyl group and (b) 25% to 95% by weight, preferably 40% to 70% by weight of alkyl acrylate ester monomers containing 12 to 24 carbon atoms in the ester alkyl group, provided that, as stated above, at least 50 mole % contain at least 6 and preferably at least 8 carbon atoms in the ester alkyl group. In an especially preferred embodiment, the alkyl acrylate ester monomers comprise alkyl methacrylate esters.

In one particular embodiment, monomer (A) comprises at least 5% by weight of alkyl acrylate esters having 4 to 11 carbon atoms in the ester alkyl group. In another embodiment, monomer (A) comprises 5% to 40%, often 10% to 40% by weight, alkyl acrylate esters having 1 to 4 carbon atoms in the ester alkyl group. In still another embodiment, monomer (A) comprises 60% to 90% by weight of alkyl acrylate esters having 9 to 11 carbon atoms in the ester alkyl group.

In one preferred embodiment, monomer (A) consists essentially of $C_{12-24}$, often $C_{12-18}$, and frequently $C_{12-15}$ methacrylates.

The acrylate ester monomers can be prepared by conventional methods well known to those of skill in the art. A variety of procedures are described in considerable detail in the section entitled "Acrylic and Methacrylic Ester Polymers" in the Encyclopedia of Polymer Science and Engineering, Vol. 1, pp. 247–251, Wiley-Interscience, New York (1985). Many alkyl acrylate esters are commercially available. Suppliers include, RohMax; San Esters Corp., with offices in New York, N.Y.; Mitsubishi Rayon Co. Ltd.; Polysciences, Inc., Warrington, Pa.; Sartomer Co., Exton, Pa.; and others.

(B) The Nitrogen-Containing Monomer

The nitrogen-containing copolymers of this invention also comprise units (B) comprising at least one nitrogen-containing monomer selected from the group consisting of vinyl substituted nitrogen heterocyclic monomers, dialkylaminoalkyl acrylate monomers, dialkylaminoalkyl acrylamide monomers, N-tertiary alkyl acrylamides, and vinyl substituted amines.

In one embodiment, the nitrogen-containing monomer is an N-vinyl substituted heterocyclic monomer. Examples of such monomers include N-vinyl imidazole, N-vinyl pyrrolidinone and N-vinyl caprolactam. In another embodiment, the vinyl substituted heterocyclic monomer is vinyl pyridine. In yet another embodiment, the nitrogen-containing monomer is a N,N-dialkylaminoalkyl acrylamide or acrylate wherein each alkyl or aminoalkyl group contains, independently, 1 to 8 carbon atoms. In a further embodiment, the nitrogen-containing monomer is a tertiary-alkyl acrylamide, preferably tertiary butyl acrylamide.

In one embodiment the dispersant viscosity modifier is prepared by polymerizing 57.5 parts methyl methacrylate, 12.7 parts butyl methacrylate, 226.5 parts each of $C_{9-11}$ methacrylate and $C_{12-15}$ methacrylate, 114.8 parts $C_{-18}$ methacrylate and 11.7 parts N-(3-(dimethylamino)propyl) methacrylamide in a staged addition process. Details of the preparation of these and related polymers are found in European Patent Application 750,031, published Dec. 27, 1996.

The copolymers described above typically have a weight average molecular weight (Mw) of 10,000 to 500,000, more often 30,000 to 250,000, frequently 20,000 to 100,000 and polydispersity values ($M_w/M_n$) of 1.2 to 5. Molecular weights of polymers are determined using well-known methods described in the literature.

The copolymers can be prepared in the presence of a diluent. A diluent can also be added to a substantially diluent-free copolymer, usually by dissolving or dispersing the substantially diluent-free polymer in an appropriate diluent. In another embodiment, an additional diluent, often a higher boiling diluent such as an oil, may be added to a copolymer which was prepared in, and still contains, a lower boiling diluent which is then removed by common methods such as distillation. In one embodiment, the diluent is a mineral oil. In a preferred embodiment the mineral oil consists essentially of hydrotreated naphthenic oil. Also contemplated are hydrodewaxed mineral oils. The diluent may also be a synthetic oil. Common synthetic oils are ester type oils, polyolefin oligomers or alkylated benzenes.

The diluent-containing copolymers of this invention are referred to herein as additive concentrates. Such additive concentrates are then added, along with other desirable performance-improving additives, to an oil of lubriating viscosity to prepare the finished lubricant composition. The additive concentrates preferably comprise 25% to 90% by weight of copolymer, preferably 35% to 85% by weight, and 10% to 75% by weight of diluent, preferably 15% to 65% by weight of diluent.

Although dispersant viscosity modifiers based on polymethacrylates are preferred for the present invention, the VM can be any of the above mentioned VMs provided they exhibit sufficient shear stability. When the VM is formulated into the composition of the present invention and the composition is subjected to the aforedescribed 20 hour Tapered Bearing Shear Test, the reduction in viscosity at 100° C. is less than 20%, and preferably less than 10%. In certain favorable case the reduction may be less than 5%.

The amount of the viscosity modifier which is employed is an amount suitable to provide the desired viscosity to the composition, as described above. Normally the amount of VM will be 1 to 25 percent by weight of the composition; preferably the amount will be 2 to 20 percent by weight, and more preferably 5 to 15 percent by weight.

The composition of the present invention further contains a defined amount of an overbased metal salt, also referred to as a detergent. Overbased materials are generally single phase, homogeneous Newtonian systems characterized by a metal content in excess of that which would be present for neutralization according to the stoichiometry of the metal and the particular acidic organic compound reacted with the metal. The overbased materials are most commonly prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol. The detergent component of the present additive mixture can be one or more borated or non-borated overbased alkali metal or alkaline earth metal salts of a sulfonate, phenate, salicylate, carbonate, or phosphorus-containing acid, or mixtures thereof.

Sulfonate salts are those having a substantially oleophilic character and which are formed form organic materials. Organic sulfonates are well known materials in the lubricant and detergent arts. The sulfonate compound should contain on average 10 to 40 carbon atoms, preferably 12 to 36 and more preferably 14 to 32 carbon atoms. Similarly, the phenates, salicylates, and carboxylates should have a substantially oleophilic character. While the carbon atoms can be either in an aromatic or paraffinic configuration, it is preferred that alkylated aromatics be used. While naphthalene based materials can be used, the preferred aromatic materials are based on benzene.

A highly preferred composition is a monosulfonated alkylated benzene, preferably the monoalkylated benzene. Typically, alkyl benzene fractions are obtained from still bottom sources and are mono- or di-alkylated. It is believed that the mono-alkylated aromatics are superior in overall properties.

It is desirable that a mixture of mono-alkylated aromatics be used to obtain the mono-alkylated salt (benzene sulfonate). Mixtures in which a substantial portion of the composition contains polymers of propylene as the source of the alkyl groups assist in the solubility of the salt in the transmission fluids of the present invention. The use of mono-functional (e.g., mono-sulfonated) materials avoids crosslinking of the molecules and possible precipitation of the salt from the lubricant.

The detergent is referred to as "overbased." By overbasing, it is meant that a stoichiometric excess of the metal be present, beyond that required to neutralize the anion of the salt. The excess metal from overbasing has the effect of neutralizing acids which may build up in the lubricant. Another important advantages is that the overbased salt increases the dynamic coefficient of friction. The overbasing is generally done such that the metal ratio is 1.05:1, preferably 2:1 to 30:1, and most preferably 4:1 to 25:1. The metal ratio is the ratio of metal ions, on an equivalent basis, to the anionic portion of the overbased material.

Preferably the overbased material is in the form of a metal salt where the metal is selected from group II of the periodic table of elements. Preferably it is a calcium or magnesium salt.

Preferably the overbased material is a carbonated material. Carbonated overbased materials are those which the low molecular weight acidic material which is preferably used in the formation of the material is carbon dioxide. The preparation of overbased materials, including carbonated overbased materials, is well known and is described, in numerous United States patents including, for example, U.S. Pat. No. 3,766,067, McMillen.

Preferably the overbased material is a carbonated overbased calcium sulfonate or a carbonated overbased calcium salicylate.

The overbased material can be borated or non-borated. Borated overbased materials and their preparation are well known and are described in greater detail in European Patent Application 753,564, published Jan. 15, 1997.

The amount of the overbased metal salt in the composition is an amount to contribute 0.5 or 1 to 10 Total Base Number, preferably 4 to 8 TBN, and more preferably 4 to 7 TBN to the composition. Total base number is the amount of acid (perchloric or hydrochloric) needed to neutralize all the basicity of a material. The amount of acid is expressed as potassium hydroxide equivalents. Total base number is normally determined by titration of one gram of material with 0.1 Normal hydrochloric acid solution using bromophenol blue as an indicator.

The suitable overbased materials themselves preferably have a total base number of 50 to 550, more preferably 100 to 450, on an oil free basis. That is, an overbased composition which contains 40% diluent oil and has a TBN of 200 will have a TBN of 333 on an oil-free basis, that is, when corrected by dividing by 0.6 to account for the inert oil. Similarly, an overbased material having a TBN of 250 (oil free basis) will contribute 5 TBN to the composition of the present invention if 20 g (oil free basis) are added to prepare 1000 g of final composition. Accordingly, the amount of overbased material which will be used in a given composition will depend in part on the extent of overbasing, that is, the TBN, of the overbased material. The appropriate amounts can be readily calculated by those skilled in the art. For many common overbased materials, the total amount will be approximately in the range of 0.2 to 1.5 percent by weight (oil free basis), preferably 0.4 to 1 percent by weight.

Another component of the present invention is a phosphorus compound. Most phosphorus compounds impart a measure of anti-wear performance to the composition.

The phosphorus compound of the present invention can be a phosphorus acid or ester of the formula $(R^1X)(R^2X)P(X)_nX_mR^3$ or a salt thereof, where each X is independently an oxygen atom or a sulfur atom, n is 0 or 1, m is 0 or 1, m+n is 1 or 2, and $R^1$, $R^2$, and $R^3$ are hydrogen or hydrocarbyl groups. Preferably at least one of $R^1$ , $R^2$, and $R^3$ is a hydrocarbyl group, and preferably at least one is hydrogen. This component thus includes phosphorous and phosphoric acids, thiophosphorous and thiophosphoric acids, phosphite esters, phosphate esters, and thiophosphite and thiophosphate esters. The esters can be mono-, di- or tri-hydrocarbyl esters. It is noted that certain of these materials can exist in tautomeric forms, and that all such tautomers are intended to be encompassed by the above formula and included within the present invention. For example, phosphorous acid and certain phosphite esters can be written in at least two ways:

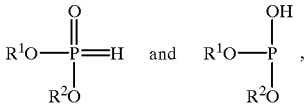

differing merely by the placement of the hydrogen. Each of these structures are intended to be encompassed by the present invention.

The phosphorus-containing acids can be at least one phosphate, phosphonate, phosphinate or phosphine oxide. These pentavalent phosphorus derivatives can be represented by the formula

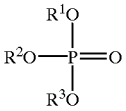

wherein $R^1$, $R^2$ and $R^3$ are independently hydrocarbyl groups, or hydrogen and a, b and c are independently zero or 1. The phosphorus-containing acid can be at least one phosphite, phosphonite, phosphinite or phosphine. These trivalent phosphorus derivatives can be represented by the formula

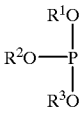

wherein $R^1$, $R^2$ and $R^3$ are independently hydrocarbyl groups, and a, b and c are independently zero or 1. The total number of carbon atoms in $R^1$, $R^2$ and $R^3$ in each of the above formulae must be sufficient to render the compound soluble in the reaction medium. Generally, the total number of carbon atoms in $R^1$, $R^2$ and $R^3$ is at least 8, and in one embodiment at least 12, and in one embodiment at least 16. There is no limit to the total number of carbon atoms in $R^1$, $R^2$ and $R^3$ that is required, but a practical upper limit is 400 or 500 carbon atoms. In one embodiment, $R^1$, $R^2$ and $R^3$ in each of the above formulae are independently hydrocarbyl groups of preferably 1 to 100 carbon atoms, or 1 to 50 carbon atoms, or 1 to 30 carbon atoms, with the proviso that the total number of carbons is at least 8. Each $R^1$, $R^2$ and $R^3$ can be the same as the other, although they may be different. Examples of useful $R^1$,$R^2$ and $R^3$ groups include hydrogen, t-butyl, isobutyl, amyl, isooctyl, decyl, dodecyl, oleyl, $C_8$ alkyl, eicosyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and the like.

In another embodiment, the phosphorus acid is characterized by at least one direct carbon-to-phosphorus linkage such as those prepared by the treatment of an olefin polymer, such as one or more of the above polyalkenes (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride.

It is preferred that at least two of the X atoms in the above structure are oxygen, so that the structure will be $(R^1O)(R^2O)P(X)_nX_mR^3$, and more preferably $(R^1, O)(R^2O)P(X)_nX_mH$. This structure can correspond, for example, to phosphoric acid when $R^1$,$R^2$, and $R^3$ are hydrogen. Phosphoric acid exists as the acid itself, $H_3PO_4$ and other forms equivalent thereto such as pyrophosphoric acid and anhydrides of phosphoric acid, including 85% phosphoric acid (aqueous), which is the commonly available commercial grade material. The formula can also correspond to a mono- or dialkyl hydrogen phosphite (a phosphite ester) when one or both of $R^1$, and $R^2$ are alkyl, respectively and $R^3$ is hydrogen, or a trialkyl phosphite ester when each of $R^1$, $R^2$, and $R^3$ is alkyl; in each case where n is zero, m is 1, and the remaining X is O. The structure will correspond to phosphoric acid or a related material when n and m are each 1; for example, it can be a phosphate ester such as a mono-, di- or trialkyl monothiophosphate when one of the X atoms is sulfur and one, two, or three of $R_6$, $R_7$, and $R_8$ are alkyl, respectively.

Phosphoric acid and phosphorus acid are well-known items of commerce. Thiophosphoric acids and thiophosphorous acids are likewise well known and are prepared by reaction of phosphorus compounds with elemental sulfur or other sulfur sources. Processes for preparing thiophosphorus acids are reported in detail in *Organic Phosphorus Compounds*, Vol. 5, pages 110–111, G. M. Kosolapoff et al., 1973.

When this component is a phosphite ester, the hydrocarbyl groups $R^1$ and $R^2$ will normally contain 1 to 30 or 24 carbon atoms, preferably 2 to 12 or 8 carbon atoms, and more preferably 4 to 8 carbon atoms. In a preferred embodiment the hydrocarbyl groups are alkyl groups and, in particular, butyl groups.

The $R^1$ and $R^2$ groups can comprise a mixture of hydrocarbyl groups derived from commercial alcohols. Examples of some preferred monohydric alcohols and alcohol mixtures include the commercially available Alfol™ alcohols marketed by Continental Oil Corporation Alfol™ 810 is a mixture containing alcohols consisting essentially of straight-chain primary alcohols having from 8 to 10 carbon atoms. Alfol™ 12 is a mixture comprising mostly $C_{12}$ fatty alcohols. Alfol™1218 is a mixture of synthetic primary straight chain alcohols having 12 to 18 carbon atoms. The Alfol™20+ alcohols are mostly, on an alcohol basis, $C_{20}$ alcohols as determined by gas-liquid chromatography. The Alfol™22+ alcohols are $C_{18-20}$ primary alcohols having mostly, on an alcohol basis, $C_{22}$ alcohols. These Alfol™ alcohols can contain a fairly large percentage (up to 40% by weight) of paraffinic compounds which can be removed before the reaction if desired.

Another commercially available alcohol mixture is Adol™ 60 which comprises about 75% by weight of a straight-chain $C_{22}$ primary alcohol, about 15% of a $C_{20}$ primary alcohol, and about 8% of $C_{18}$ and $C_{24}$ alcohols. Adol™ 320 comprises predominantly oleyl alcohol. The Adol™ alcohols are marketed by Ashland Chemical.

A variety of mixtures of monohydric fatty alcohols derived from naturally occurring triglycerides and ranging in chain length from $C_8$ to $C_{18}$ are available from Procter & Gamble Company. These mixtures contain various amounts of fatty alcohols containing mainly 12, 14, 16, or 18 carbon atoms. For examples, CO-1214™ is a fatty alcohol mixture containing 0.5% $C_{10}$ alcohol. 66Ô$C_{12}$ alcohol, 26% $C_{14}$ alcohol, and 6.5% $C_{16}$ alcohol.

Another group of commercially available mixtures include the Neodol™ products available from Shell Chemical Co. For example, Neodol™ 23 is a mixture of $C_{12}$ and $C_{15}$ alcohols; Neodol™ 25 is a mixture of $C_{12}$ and $C_{15}$ alcohols, and Neodol™ 45 is a mixture of $C_{14}$ and $C_{15}$ linear alcohols. Neodol™ 91 is a mixture of $C_9$, $C_{10}$, and $C_{11}$ alcohols.

Other alcohols which can be used are lower molecular weight alcohols such as methanol, ethanol, propanol, isopropanol, normal butanol, isobutanol, tert-butanol, the pentanols, hexanols, heptanols, octanols (including 2-ethyl hexanol), nonanols, decanols, and mixtures thereof.

The dihydrocarbyl hydrogen phosphites of this invention can be prepared by techniques well known in the art, and many such phosphites are available commercially. In one method of preparation, a lower molecular weight dialkylphosphite (e.g., dimethyl) is reacted with alcohols comprising a straight-chain alcohol, a branched-chain alcohol, or mixtures thereof. As noted above, each of the two types of alcohols may themselves comprise mixtures. Thus, the straight-chain alcohol can comprise a mixture of straight-chain alcohols and the branched-chain alcohol can comprise a mixture of branched-chain alcohols. The higher molecular weight alcohols replace the methyl groups in a manner analogous to classic transesterification, with the formation of methanol which is stripped from the mixture. In another embodiment, the branched-chain hydroarbyl group can be introduced into a dialkylphosphite be reacting the low molecular weight dialkylphosphite such as dimethylphosphite with a more sterically hindered branched-chain alcohol such as neopentyl alcohol (2,2-dimethyl-1-propanol). In this reaction, one of the methyl groups is replaced by a neopentyl group and, perhaps because of this of the neopentyl group, the second methyl group is not displaced. Another neo alcohol having such utility is 2,2,4-trimethyl-1-pentanol. One preferred material is dibutyl hydrogen phosphite, which is commercially available from a variety of sources including Mobil Chemical Company.

In one embodiment, the phosphorus-containing agent is a hydrocarbyl phosphate. The phosphate may be a mono-, di- or trihydrocarbyl phosphate. The hydrocarbyl groups each independently contain from 1 to 30 carbon atoms, preferably 1 to 24 carbon atoms, more preferably 1 to 12 carbon atoms. In a preferred embodiment, each hydrocarbyl is independently an alkyl or aryl group. When any group is an aryl group it contains from 6 to 24 carbon atoms, more preferably 6 to 18 carbon atoms. Examples of hydrocarbyl groups include a butyl, amyl, hexyl, octyl, oleyl or cresyl, with octyl and cresyl being preferred.

Hydrocarbyl phosphates can be prepared by reacting phosphorus acid or anhydride, preferably phosphorus pentoxide with an alcohol at a temperature of 30° C. to 200° C., preferably 80° C. to 150° C. The phosphorus acid is generally reacted with the alcohol in a ratio of about 1:3.5, preferably 1:3.

The hydrocarbyl groups can be derived from a mixture of hydrocarbyl groups derived from alcohols, including commercially available alcohols, such as have been described in detail above.

In another embodiment, the hydrocarbyl phosphate can be a hydrocarbyl thiophosphate. Thiophosphates may contain from one to three sulfur atoms, preferably one or two sulfur atoms. The thiophosphates may have the same hydrocarbyl group as described above. Thiophosphates are prepared by reacting one or more of the above-described phosphites with a sulfurizing agent including sulfur, sulfur halides, and sulfur containing compounds, such as sulfurized olefins, sulfurized fats, mercaptans and the like.

In another embodiment, the phosphorus compound can be a phosphorus-containing amide. Phosphorus-containing amides are generally prepared by reacting one of the above-described phosphorus acids such as a phosphoric, phosphonic, phosphinic, thiophosphoric, including dithiophosphoric as well as monothiophosphoric, thiophosphinic or thiophosphonic acids with an unsaturated amide, such as an acrylamide. Preferably the phosphorus acid is a dithiophosphorus acid prepared by reacting a phosphorus sulfide with an alcohol or phenol to form dihydrocarbyl dithiophosphoric acid. The hydrocarbyl groups may be those described above for hydrocarbyl phosphates.

In one embodiment, phosphorus-containing amide is represented by the formula:

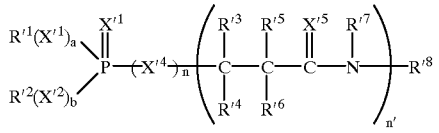

wherein each $X'^1$, $X'^2$, $X'^3$, $X'^4$ and $X'^5$ is independently oxygen or sulfur; each $R'^1$ and $R'^2$ is independently a hydrocarbyl group; each $R'^3$, $R'^4$, $R'^5$, $R'^6$ and $R'^7$ is independently a hydrogen, halogen or hydrocarbyl group; a and b independently are zero or 1; n is zero or 1; n' is 1, 2 or 3; with the proviso that:

(1) when n' is 1, $R'^8$ is hydrogen, —R#, —ROH, —ROR, —RSR or

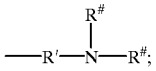

(2) when n' is 2, $R'^8$ is a coupling group selected from —R'—, —R*—, —R'—O—R'—,

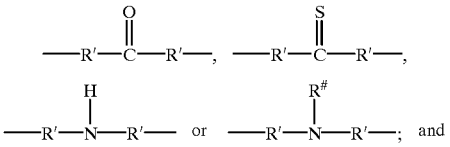

(3) when n' is 3, $R'^8$ is the coupling group

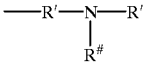

wherein each R# is independently a hydrocarbyl group of 1 to 12 carbon atoms; and each R' is independently an arylene, or an alkylene or alkylidene group having from 1 to 12 carbon atoms. $X'^1$, $X'^2$ and $X'^5$ are preferably oxygen. $X'^3$ and $X'^4$ are preferably sulfur and a and b are preferably 1. Each $R'^1$ and $R'^2$ is preferably independently a hydrocarbyl group of from 1 to 50 carbon atoms, more preferably from 1 to 30 carbon atoms, more preferably from 3 to 18 carbon atoms, more preferably from 4 to 8 carbon atoms. Each $R'^1$ and $R'^2$ is preferably an alkyl group. Examples of $R'^1$ and $R'^2$ are t-butyl, isobutyl, amyl, isooctyl, decyl, dodecyl, eicosyl, 2-pentenyl, dodecenyl, phenyl, naphthyl, alkylphenyl, alkylnaphthyl, phenylalkyl, naphthylalkyl, alkylphenylalkyl, and alkylnaphthylalkyl groups. Each $R'^3$, $R'^4$, $R'^5$, $R'^6$ and $R'^7$ is preferably independently a hydrogen or hydrocarbyl group of 1 to 50 carbon atoms, more preferably 1 to 30, more preferably 1 to 18, more preferably 1 to 8. Advantageously, each $R'^3$, $R'^4$, $R'^5$, $R'^6$ and $R'^7$ is independently a hydrogen; an alkyl group of from 1 to 22 carbon atoms; a cycloalkyl group of from 4 to 22 carbon atoms; or an aromatic, an alkyl-substituted aromatic or an aromatic-substituted alkyl group of from 4 to 34 carbon atoms. Preferably each R' is independently an alkylene or alkylidene group having from 1 to 12, more preferably from 1 to 6, more preferably 1 carbon atom. R' is preferably methylene, ethylene, or propylene with preferably methylene.

The phosphorus-containing amides can be prepared by the reaction of a phosphorus-containing acid, preferably a dithiophosphoric acid, as described above with an acrylamide such as acrylamide, N,N'-methylenebisacrylamide, methacrylamide, crotonamide, and the like. The reaction product from above may be further reacted with linking or coupling compounds, such as formaldehyde or paraformaldehyde to form coupled compounds.

Other phosphorus-containing materials are phosphites such as triphenylphosphite and diphenylphosphite.

Another phosphorus-containing compound can be a metal salt of a dihydrocarbyl dithiophosphoric acid. In such materials, commonly the dithiophosphoric acid is prepared by reacting phosphorus pentasulfide with an alcohol mixture comprising at least 10 mole percent of isopropyl alcohol and at least one primary alcohol containing from 3 to 13 carbon atoms. Typical metal is a Group II metal, aluminum, tin, iron, cobalt, lead, molybdenum, manganese, nickel, or copper, and typically zinc.

The phosphorodithioic acids from which the metal salts useful in this invention are prepared are obtained by the reaction of about 4 moles of an alcohol mixture per mole of phosphorus pentasulfide, and the reaction may be carried out within a temperature range of from 50° to 200° C. The reaction generally is completed in 1 to 10 hours, and hydrogen sulfide is liberated during the reaction.

The alcohol mixture which is utilized in the preparation of the dithiophosphoric acids typically comprise a mixture of isopropyl alcohol and at least one primary aliphatic alcohol containing from 3 to 13 carbon atoms. In particular, the alcohol mixture can contain at least 10 mole percent of isopropyl alcohol and will generally comprise from 20 mole percent to 90 mole percent of isopropyl alcohol. In one preferred embodiment, the alcohol mixture will comprise from 40 to 60 mole percent of isopropyl alcohol, the remainder being one or more primary aliphatic alcohols.

The primary alcohols which may be included in the alcohol mixture include n-butyl alcohol, isobutyl alcohol, n-amyl alcohol, isoamyl alcohol, n-hexyl alcohol, 2-ethyl-1-hexyl alcohol, isooctyl alcohol, nonyl alcohol, decyl alcohol, dodecyl alcohol, tridecyl alcohol, etc. The primary alcohols also may contain various substituent groups such as halogens. Particular examples of useful mixtures include, for example, isopropyl/n-butyl; isopropyl/secondary butyl; isopropyl/2-ethyl-1-hexyl; isopropyl/isooctyl; isopropyl/decyl; isopropyl/dodecyl, and isopropyl/tridecyl.

The composition of the phosphorodithioic acid obtained by the reaction of a mixture of alcohols with phosphorus pentasulfide is actually a statistical mixture of three or more phosphorodithioic acids as illustrated by the following formulas:

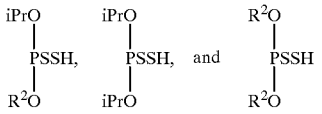

It is preferred to select the amount of the two or more alcohols reacted with the $P_2S_5$ to result in a mixture in which the predominating dithiophosphoric acid is the acid (or acids) containing one isopropyl group and one primary alkyl group. Relative amounts of the three phosphorodithioic acids in the statistical mixture is dependent, in part, on the relative amounts of the alcohols in the mixture, steric effects, and the like.

The preparation of the metal salt of the dithiophosphoric acids can be effected by reaction with the metal or metal oxide. Simply mixing and heating these two reactants is sufficient to cause the reaction to take place and the resulting product is sufficiently pure for the purposes of this invention. Typically the formation of the salt is carried out in the presence of a diluent such as an alcohol, water, or diluent oil. Neutral salts are prepared by reacting one equivalent of metal oxide or hydroxide with one equivalent of the acid. Basic metal salts are prepared by adding an excess of (more than one equivalent of) the metal oxide or hydroxide with one equivalent of phosphorodithioic acid.

The metal salts of dihydrocarbyl dithiophosphoric acids which are useful in this invention include those salts containing Group II metals, aluminum, lead, tin, molybdenum, manganese, cobalt, and nickel. Zinc and copper are especially useful metals. Examples of metal compounds which may be reacted with the acid include silver oxide, silver carbonate, magnesium oxide, magnesium hydroxide, magnesium carbonate, magnesium ethylate, calcium oxide, calcium hydroxide, zinc oxide, zinc hydroxide, strontium oxide, strontium hydroxide, cadmium oxide, cadmium carbonate, barium oxide, barium hydrate, aluminum oxide, aluminum propylate, iron carbonate, copper hydroxide, lead oxide, tin butylate, cobalt oxide, and nickel hydroxide.

The amount of the phosphorus-containing agent is at least 0.1 percent by weight based on the composition of the composition of the present invention, preferably 0.14 to 0.25 percent by weight. The preferred amount is that amount suitable to provide measurable antiwear protection to a transmission which is lubricated by the present fluid. Otherwise stated, a preferable amount is that which provides 0.005 to 0.05 weight percent phosphorus to the composition. The preferred amount can be adjusted by the person skilled in the art to take into account the varying degrees of efficiency among phosphorus compounds in providing antiwear protection.

The present invention further comprises a friction modifier component, which in turn comprises a combination of at least two friction modifiers. Friction modifiers are very well known in the art, and the number and types of compounds are voluminous. In general, friction modifiers include metal salts of fatty acids, fatty phosphites, fatty acid amides, fatty epoxides and borated derivatives thereof, fatty amines, glycerol esters and their borated derivatives, alkoxylated fatty amines (including ethoxylated fatty amines such as diethoxylated tallowamine) and their borated derivatives, sulfurized olefins, sulfurized polyolefins, sulfurized fats, and sulfurized fatty acids.

For the present invention, at least one of the two or more friction modifiers must be selected from among the following materials: (a) zinc salts of fatty acids having at least 10 carbon atoms; (b) hydrocarbyl imidazolines containing at least 12 carbon atoms in the hydrocarbyl group, and (c) borated epoxides. The second and any additional friction modifiers may be selected from the same group, or they can be selected from friction modifiers generally, as listed, for example, in the preceding paragraph. If the one of the friction modifiers is a phosphorus-containing material (e.g., a fatty phosphite or phosphoric acid), it is intended that the same material can be counted as both a friction modifier and as a phosphorus-containing compound. The amount of any such phosphorus-containing friction modifier should be selected such that the requirements for the amount and performance of friction modifiers and the amount of phosphorus-containing compounds are simultaneously satisfied.

Zinc salts of fatty acids are well known materials. Fatty acids are generally hydrocarbon-based carboxylic acids, both synthetic and naturally occurring, preferably aliphatic acids, although acids containing aromatic functionality are also included. Occasional heteroatom substitution can be permitted in the hydrocarbyl portion of the fatty acid, consistent with the definition of "hydrocarbyl," below. Preferably the acid contains 14 to 30 carbon atoms, more preferably 16–24 carbon atoms, and preferably about 18 carbon atoms. The acid can be straight chain (e.g. stearic) or branched (e.g., isostearic). The acid can be saturated or it can contain olefinic unsaturation. A preferred acid is oleic acid, and the correspondingly preferred salt is zinc oleate, a commercially available material, the preparation of which is well known and is within the abilities of the person skilled in the art.

The zinc salt can be a neutral salt, that is, in which one equivalent of zinc is reacted with one equivalent of acid such as oleic acid. Alternatively, the zinc salt can be a slightly basic salt, in which one equivalent of a zinc base is reacted with somewhat less than one equivalent of acid. An example of such a material is a slightly "over-zinc-ed" oleate, that is, $Zn_4Oleate_3O_1$.

Alkyl-substituted imidazolines are also well known materials. They can generally be formed by the cyclic condensation of a carboxylic acid with a 1,2 diaminoethane compound. They generally have the structure

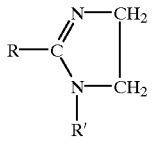

where R is an alkyl group and R' is a hydrocarbyl group or a substituted hydrocarbyl group, including $—(CH_2CH_2NH)_n—H$ groups.

Among the numerous suitable carboxylic acids useful in preparing the imidazoline are oleic acid, stearic acid, isostearic acid, tall oil acids, and other acids derived from natural and synthetic sources. Specially preferred carboxylic acids are those containing 12 to 24 carbon atoms including the 18 carbon acids such as oleic acid and stearic acid. Among suitable 1,2 diaminoethane compounds are compounds of the general structure $R—NH—C_2H_4—NH_2$, where R is a hydrocarbyl group or a substituted hydrocarbyl group (e.g., hydroxy hydrocarbyl, aminohydrocarbyl). A preferred diamine is N-hydroxyethyl-1,2-diaminoethane, $HOC_2H_4NHC_2H_4NH_2$.

A preferred alkyl-substituted imidazoline is 1-hydroxyethyl-2-heptadecenyl imidazoline.

Another type of friction modifier includes borated epoxides, which are described in detail in U.S. Pat. No. No. 4,584,115, and are generally prepared by reacting an epoxide, preferably a hydrocarbyl epoxide, with boric acid or boron trioxide. The epoxide can be expressed by the general formula

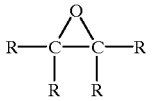

wherein each R is independently hydrogen or a hydrocarbyl group containing 8 to 30 carbon atoms, at least one of which is hydrocarbyl. Also included are materials in which any two of the R groups together with the atoms to which they are attached, for a cyclic group, which can be alicyclic or heterocyclic. Preferably one R is a hydrocarbyl group of 10 to 18 carbon atoms and the remaining R groups are hydrogen. More preferably the hydrocarbyl group is an alkyl group. The epoxides can be commercial mixtures of $C_{14-16}$ or $C_{14-18}$ epoxides, which can be purchased from ELF-ATOCHEM or Union Carbide and which can be prepared from the corresponding olefins by known methods. Purified epoxy compounds such as 1,2-epoxyhexadecane can be purchased from Aldrich Chemicals. Alternatively this material can be a reactive equivalent of an epoxide. By the term "reactive equivalent of an epoxide" is meant a material which can react with a boronating agent (described below) in the same or a similar manner as can an epoxide to give the same or similar products. An example of a reactive equivalent of an epoxide is a diol. Another example of a reactive equivalent to epoxides is the halohydrins. Other equivalents will be apparent to those skilled in the art. Other reactive equivalents include materials having vicinal dihydroxy groups which are reacted with certain blocking reagents. The borated compounds are prepared by blending the boron compound and the epoxide and heating them at a suitable temperature, typically 80° to 250° C., until the desired reaction has occurred. Boronating agents include the various forms of boric acid (including metaboric acid, $HBO_2$, orthoboric acid, $H_3BO_3$, and tetraboric acid, $H_2B_4O_7$), boric oxide, boron trioxide, and alkyl borates of the formula $(RO)_x,B(OH)_y$ wherein X is 1 to 3 and y is 0 to 2, the sum of x and y being 3, and where R is an alkyl group containing 1 to 6 carbon atoms. The molar ratio of the boronating agent to the epoxide or reactive equivalent thereof is generally 4:1 to 1:4. Ratios of 1:1 to 1:3 are preferred, with 1:2 being an especially preferred ratio. An inert liquid can be used in performing the reaction. The liquid may be toluene, xylene, chlorobenzene, dimethylformamide and the like. Water is formed and is typically distilled off during the reaction. Alkaline reagents can be used to catalyze the reaction. A preferred borated epoxide is the borated epoxide of a predominantly 16 carbon olefin. The amount of the friction modifier component (the combination of at least two friction modifiers) is preferably 0.1 to 0.45 percent by weight of the composition, preferably 0.15 to 0.3 percent, and more preferably 0.2 to 0.25 percent by weight. The amount of the friction modifier component which is selected from group of zinc oleates, alkyl-substituted imidazolines, and borated epoxides is at least 0.03 percent by weight of the composition, preferably 0.04 to 0.15 percent, and more preferably 0.05 to 0.09 percent. Preferably one friction modifier is zinc oleate or alkylsubstituted imidazoline, and is present in an amount of 0.05 to 0.09 weight percent of the composition. Alternatively, preferably one friction modifier is a borated epoxide of a predominantly 16-carbon olefin, present in an amount of 0.1 to 0.22 percent by weight of the composition. Preferably the amount of a second friction modifier is 0.05 to 0.1 weight percent of the composition.

The total amount of the friction modifiers (of all types) is limited to those amounts which provide a metal-to-metal coefficient of friction of at least 0.120 as measured at 110° C. by ASTM-G-77, using the composition as a lubricant, since such minimum friction is important for the presently contemplated application, that is, fluids suitable for continuously variable transmissions. Preferably the amount of friction modifiers is sufficient to provide a coefficient of friction of 0.125 to 0.145, and more preferably about 0.135.

The composition of the present invention can be supplied as a fully formulated lubricant or functional fluid, or it can be supplied as a concentrate. In a concentrate, the relative amounts of the various components will generally be about the same as in the fully formulated composition, except that the amount of oil of lubricating viscosity will be decreased by an appropriate amount. The absolute percentage amounts of the remaining components will be correspondingly increased. Thus, when the concentrate is added to an appropriate amount of oil, the final formulation of the present invention will be obtained.

Therefore, expressed in one way, one embodiment of such a concentrate will comprise:

(a) a concentrate-forming amount of an oil of lubricating viscosity (which will typically be 10 to 50 percent by weight of the concentrate);

(b) a shear stable viscosity modifier in an amount which, upon dilution of the concentrate by addition to oil to form an automatic transmission fluid, modifies the viscosity of the resulting fluid;

(c) an overbased metal salt in an amount of at least 0.2 percent by weight, which amount, upon said dilution, contributes 0.1 or 1 to 10 Total Base Number to said automatic transmission fluid;

(d) at least 0.2 percent by weight of at least one phosphorus compound; and (e) at least 0.2 percent by weight of a combination of at least two friction modifiers, at least one of said friction modifiers being selected from the group consisting of zinc salts of fatty acids having at least 10 carbon atoms, hydrocarbyl imidazolines containing at least 12 carbon atoms in the hydrocarbyl group, and borated epoxides; the amount of the friction modifier from said group being at least 0.06 percent by weight of the concentrate;

provided that the total amount of the friction modifiers is limited to those amounts which provide a metal-to-metal coefficient of friction, upon said dilution of the concentrate, of at least about 0.120 as measured at 110° C. by ASTM-G-77.

Expressed in another way, the components of the present invention, whether in a concentrate or in a fully formulated fluid, will in one embodiment be:

(a) an oil of lubricating viscosity;

(b) 2 to 0 parts by weight of a shear stable viscosity modifier;

(c) 0.2 to 1.5 parts by weight of an overbased metal salt;

(d) 0.14 to 0.25 parts by weight of at least one phosphorus compound; and (e) 0.15 to 0.3 parts by weight of a combination of at least two friction modifiers, at least one of said friction modifiers being selected from the group consisting of zinc salts of fatty acids having at least 10 carbon atoms, hydrocarbyl imidazolines containing at least 12 carbon atoms in the hydrocarbyl group, and borated epoxides; the amount of the friction modifier from said group being at least 0.03 parts by weight.

Thus, in a fully formulated composition, the amount of the oil of lubricating viscosity will be as set forth above, or 50 to 95 parts by weight. In a concentrate, similarly, the amount of the oil of lubricating viscosity will be 10 to 50 parts by weight or other intermediate values that may be appropriate. Other amounts of the various components may be independently selected from a consideration of the broad, preferred, and most preferred percent ranges of such components set forth above. An exhaustive listing of such combinations on a parts-by-weight basis is not recited herein for the sake of brevity; however, such combinations can well be determined by the person skilled in the art seeking to prepare a concentrate.

Other materials can be included in the compositions of the present invention, provided that they are not incompatible with the aforementioned required components or specifications (such as the coefficient of friction requirement). Such optional materials include dispersants (sometimes referred to as "ashless dispersants"), which may be included, for instance, in amounts of up to 10 weight percent on an oil free basis. Examples of dispersants include carboxylic dispersants, which can be the reaction product of carboxylic acylating agents with nitrogen- or hydroxy-containing compounds; amine dispersants; Mannich dispersants, post-treated dispersants, and polymeric dispersants. Other optional materials include antioxidants, including hindered phenolic antioxidants, secondary aromatic amine antioxidants, sulfurized phenolic antioxidants, oil-soluble copper compounds, phosphorus-containing antioxidants, organic sulfides, disulfides, and polysulfides. Other optional components include seal swell compositions, such as isodecyl sulfolane, which are designed to keep seals pliable. Also permissible are pour point depressants, such as alkylnaphthalenes, polymethacrylates, vinyl acetate/fumarate or /maleate copolymers, and styrene/maleate copolymers. These optional materials are known to those skilled in the art, are generally commercially available, and are described in greater detail in published European Patent Application 761,805. Also included can be corrosion inhibitors, dyes, fluidizing agents, and antifoam agents.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The compositions of the present invention can be used as lubricating oils and greases useful in industrial applications and in automotive engines, transmissions and axles. These compositions are effective in a variety of applications including crankcase lubricating oils for spark-ignited and compression-ignited internal combustion engines, including automobile and truck engines, two-cycle engines, aviation piston engines, marine and low-load diesel engines, and the like. Also, automatic transmission fluids, manual transmission fluids, transaxle lubricants, gear lubricants, metalworking lubricants, hydraulic fluids, and other lubricating oil and grease compositions can benefit from the incorporation of the compositions of this invention. The inventive functional fluids are particularly effective as automatic transmission fluids, particularly fluids for continuously variable transmissions, including push-belt type and toroidal traction drive transmissions.

It is believed that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

EXAMPLES

The following compositions, expressed in parts by weight, are prepared and used as fluids for continuously variable transmissions. The coefficient of friction of certain of the compositions is measured using ASTM-G-77:

Example 1 a mixture of:

100 parts by weight oil of lubricating viscosity (natural+synthetic)

5.0 parts shear stable dispersant viscosity modifier 1.8 parts overbased calcium sulfonate, including 1.3 parts diluent oil (100 TBN)

0.2 parts dibutyl hydrogen phosphite 0.05 parts zinc dithiophosphate 0.08 parts zinc oleate 0.14 parts ethoxylated fatty amine 1.9 parts mixture of borated polyamine dispersant and polyamine dispersant reacted with $CS_2$ 0.9 parts antioxidants 0.3 parts seal swell agent 420 ppm antifoam agents 2.4 parts additional diluent oil (from various of the above components)

Coefficient of Friction: 0.131

Example 2 a mixture of 100 parts oil of lubricating viscosity 7.4 parts shear stable dispersant viscosity modifier 0.84 parts overbased calcium sulfonate, including 0.42 parts diluent oil (13 TBN)

0.40 parts overbased calcium salicylate, including 0.16 parts diluent oil (165 TBN)

0.15 parts dibutyl hydrogen phosphite 0.08 parts alkyl hydrogen phosphite 0.04 parts phosphoric acid (85%)

0.2 parts borated alpha olefin epoxide 0.02 parts ethoxylated fatty amine 2.0 parts amine dispersants, mixture of borated, non-reacted, and species reacted with $CS_2$ 0.9 parts antioxidants 0.6 parts seal swell agent 0.03 parts corrosion inhibitor 0.025 parts dye 460 ppm antifoam agents 3.8 parts additional diluent oils (from above components)

Coefficient of friction: 0.133

Example 3

Example 2 is substantially repeated except in place of the ethoxylated fatty amine, there is included an equivalent amount of 1-hydroxyethyl-2-heptadecenyl imidazoline friction modifier.

Example 4

Example 2 is substantially repeated except there is added, in addition, 0.3 parts overbased calcium sulfonate, (300 TBN). Coefficient of friction: 0.130.

Example 5 a mixture of 100 parts oil of lubricating viscosity 4.6 parts shear stable dispersant viscosity modifier 0.84 parts overbased calcium sulfonate, including 0.42 parts diluent oil (13 TBN)

0.3 parts overbased calcium sulfonate, including 0.1 part diluent oil (300 TBN)

0.15 parts dibutyl hydrogen phosphite 0.03 parts phosphoric acid, 85%

0.2 parts borated alpha olefin epoxide 0.2 parts ethoxylated fatty amine 2.0 parts amine dispersants, mixture of borated, non-reacted, and species reacted with $CS_2$ 0.9 parts antioxidants 0.33 parts seal swell agent 430 ppm antifoam agents 5.1 parts additional diluent oil (from various of the above)

Coefficient of Friction: 0.129

Example 6 a mixture of 100 parts oil of lubricating viscosity 5.0 parts shear stable dispersant viscosity modifier 0.6 parts overbased calcium alkylaromatic sulfonate (150 TBN)

0.2 parts dihexyl hydrogen phosphite 0.2 parts borated alpha olefin epoxide 0.02 parts ethoxylated fatty amine 0.5 parts Mannich dispersant.

Example 7 a mixture of 100 parts oil of lubricating viscosity 5.8 parts shear stable viscosity modifier 2.26 parts overbased calcium sulfonate, including 1.65 parts diluent oil (100 TBN)

0.15 parts dibutyl hydrogen phosphite 0.06 parts zinc dithiophosphate 0.126 parts ethoxylated fatty amine 0.06 parts 1-hydroxyethyl-2-heptadecenyl imidazoline 2.3 parts mixture of borated polyamine dispersant and polyamine dispersant reacted with $CS_2$ 0.9 parts antioxidants 0.3 parts seal swell agent 2.1 parts additional diluent oil (from various of the above components)

Coefficient of Friction: 0.133

Example 8 a mixture of 100 parts oil of lubricating viscosity 5 parts shear stable dispersant viscosity modifier 1.0 parts overbased calcium sulfonate, including 0.7 parts diluent oil (100 TBN)

0.03 parts phosphoric acid (85%)

0.2 parts diphenyl hydrogen phosphite 1.0 parts sulfurized triphenylphosphite 0.1 parts borated alpha olefin epoxide 0.05 parts ethoxylated fatty amine 0.1 parts corrosion inhibitors 0.9 parts antioxidants 2.5 parts amine dispersants, mixture of borated, non-reacted, and species reacted with $CS_2$ 0.4 parts seal swell agent 420 ppm antifoam agents 2.1 parts additional diluent oil (from various of the above)

Coefficient of friction: 0.135

Example 9

Example 1 is substantially repeated except that the 1.8 parts overbased calcium sulfonate (100 TBN) is replaced with 0.57 parts overbased calcium sulfonate (300 TBN) and 0.34 parts overbased calcium sulfonate (13 TBN). The coefficient of friction is 0.133.

Example 10

Example 1 is substantially repeated except that the 0.08 parts zinc oleate is replaced with 0.05 parts 1-hydroxyethyl-2-heptadecenyl imidazoline, and the amount of ethoxylated fatty amine is reduced to 0.10 parts. The coefficient of friction is 0.126.

Example 11

Example 2 is substantially repeated except the amount of the calcium salicylate (165 TBN) is reduced to 0.20 parts and there is added 0.3 parts overbased calcium sulfonate (300 TBN) and 0.04 parts 1-hydroxyethyl-2-heptadecenyl imidazoline. The coefficient of friction is 0.135.

Example 12

Example 5 is substantially repeated except the amount of dibutyl hydrogen phosphite is 0.2 parts, the amount of ethoxylated fatty amine is 0.1 parts, and there is added 0.5 parts overbased calcium salicylate (165 TBN) and 0.1 parts alkyl hydrogen phosphite. The coefficient of friction is 0.128.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A composition comprising:

(a) a major amount of an oil of lubricating viscosity;

(b) a viscosity modifying amount of a shear stable viscosity modifier;

(c) at least about 0.1 percent by weight of an overbased metal salt, wherein said overbased salt contributes about 0.5 to about 10 Total Base Number to the composition;

(d) at least about 0.1 percent by weight of at least one phosphorus compound; and (e) about 0.1 to 0.45 percent by weight of a combination of at least two friction modifiers, at least one of said friction modifiers being selected from the group consisting of zinc salts of fatty acids having at least 10 carbon atoms, hydrocarbyl imidazolines containing at least 12 carbon atoms in the hydrocarbyl group, and borated epoxides; the amount of the friction modifier from said group being at least about 0.03 percent by weight of the composition;

provided that the total amount of the friction modifiers is limited to those amounts which provide a metal-to-metal coefficient of friction of at least 0.120 as measured at 110° C. by ASTM-G-77, using the composition as a lubricant.

2. The composition of claim 1 wherein the combination of oil of lubricating viscosity and the shear stable viscosity index improver is selected so as to provide a Brookfield viscosity at −40° C. of less than about 20,000 cP, an initial kinematic viscosity of about 7 to about 8 cSt at 100° C., and a kinematic viscosity when measured after a 20 hour Tapered Bearing Shear Test of not less than 6.5 cSt at 100° C.

3. The composition of claim 1 wherein the viscosity modifier is an acrylate- or methacrylate-containing polymer or a copolymer of styrene and an ester of an unsaturated carboxylic acid.

4. The composition of claim 1 wherein the shear stable viscosity modifier is a dispersant viscosity modifier.

5. The composition of claim 1 wherein the amount of the viscosity modifier comprises about 1 to about 25 percent by weight of the composition.

6. The composition of claim 5 wherein the amount of the viscosity modifier comprises about 5 to about 15 percent by weight of the composition.

7. The composition of claim 1 wherein the overbased metal salt is an overbased group II metal salt.

8. The composition of claim 7 wherein the overbased group II metal salt of (c) comprises a carbonated overbased calcium, magnesium, or barium salt.

9. The composition of claim 7 wherein the overbased group II metal salt is borated.

10. The composition of claim 7 wherein the overbased group II metal salt of (c) is a carbonated overbased calcium sulfonate or a carbonated overbased calcium salicylate.

11. The composition of claim 7 wherein the overbased group II metal salt comprises a composition of an overbased calcium sulfonate in an oil medium and has a Total Base Number of about 50 to about 550, calculated on an oil-free basis.

12. The composition of claim 11 wherein the Total Base Number is about 100 to about 450 on an oil-free basis.

13. The composition of claim 1 wherein the phosphorus compound is a dialkyl hydrogen phosphite.

14. The composition of claim 1 wherein the overbased group II metal salt contributes about 4 to about 7 Total Base Number to the composition.

15. The composition of claim 1 wherein the combination of friction modifiers includes at least one friction modifier selected from the group consisting of zinc oleates, alkyl-substituted imidazolines, and borated epoxides.

16. The composition of claim 15 wherein the composition includes a zinc oleate.

17. The composition of claim 15 wherein the composition includes an alkyl-substituted imidazoline.

18. The composition of claim 17 wherein the alkyl-substituted imidazoline is 1-hydroxyethyl-2-heptadecenylimidazoline.

19. The composition of claim 15 wherein the composition includes a borated epoxide of a predominantly 16-carbon olefin.

20. The composition of claim 1 wherein one of the friction modifiers is an ethoxylated fatty amine.

21. The composition of claim 20 wherein the ethoxylated fatty amine is diethoxylated tallowamine.

22. The composition of claim 1 wherein the amount of friction modifiers is suitable to provide a coefficient of friction of 0.125 to 0.145 as measured at 110° C. by ASTM-G-77.

23. The composition of claim 1 wherein one friction modifier is zinc oleate or alkyl-substituted imidazoline and is present in an amount of about 0.05 to about 0.09 weight percent of the composition.

24. The composition of claim 23 wherein the amount of a second friction modifier is about 0.05 to about 0.1 weight percent of the composition.

25. The composition of claim 1 wherein one friction modifier is a borated epoxide of a predominantly 16-carbon olefin and is present in an amount of about 0.1 to about 0.22 percent by weight of the composition.

26. The composition of claim 25 wherein the amount of a second friction modifier is about 0.02 to about 0.05 percent by weight of the composition.

27. A composition prepared by admixing the components of claim 1.

28. A method for lubricating a continuously variable transmission comprising supplying thereto the composition of claim 1.

29. A composition comprising:

(a) an oil of lubricating viscosity;

(b) about 2 to about 20 parts by weight of a shear stable viscosity modifier;

(c) about 0.2 to about 1.5 parts by weight of an overbased metal salt;

(d) about 0.14 to about 0.25 parts by weight of at least one phosphorus compound; and (e) about 0.15 to about 0.3 parts by weight of a combination of at least two friction modifiers, at least one of said friction modifiers being selected from the group consisting of zinc salts of fatty acids having at least 10 carbon atoms, hydrocarbyl imidazolines containing at least 12 carbon atoms in the hydrocarbyl group, and borated epoxides; the amount of the friction modifier from said group being at least about 0.03 parts by weight.

30. The composition of claim 29 wherein the amount of the oil of lubricating viscosity is about 50 to about 95 parts by weight.

31. The composition of claim 29 wherein the amount of the oil of lubricating viscosity is about 10 to about 50 parts by weight.

32. A concentrate, capable of being diluted by addition of an oil of lubricating viscosity to form a composition suitable for use as an automatic transmission fluid, said concentrate comprising:

(a) a concentrate-forming amount of an oil of lubricating viscosity;

(b) a shear stable viscosity modifier in an amount which, upon said dilution, modifies the viscosity of said automatic transmission fluid;

(c) an overbased metal salt in an amount of at least about 0.2 percent by weight, which amount, upon said dilution, contributes about 0.5 to about 10 Total Base Number to said automatic transmission fluid;

(d) at least about 0.2 percent by weight of at least one phosphorus compound; and (e) at least about 0.2 percent by weight of a combination of at least two friction modifiers, at least one of said friction modifiers being selected from the group consisting of zinc salts of fatty acids having at least 10 carbon atoms, hydrocarbyl imidazolines containing at least 12 carbon atoms in the hydrocarbyl group, and borated epoxides; the amount of the friction modifier from said group being at least about 0.06 percent by weight of the concentrate;

provided that the total amount of the friction modifiers is limited to those amounts which provide a metal-to-metal coefficient of friction, upon said dilution of the concentrate, of at least 0.120 as measured at 110° C. by ASTM-G-77.

33. The composition of claim 1 wherein the phosphorus compounds of component (d) comprise a mixture of phosphoric acid, dialkyl hydrogen phosphite, and sulfurized triphenylphosphite.

* * * * *